United States Patent [19]

Bodine

[11] Patent Number: 4,662,459

[45] Date of Patent: May 5, 1987

[54] DRILLING SYSTEM AND METHOD EMPLOYING TORSIONAL SONIC VIBRATION FOR LUBRICATION OF JOURNAL TYPE BIT BEARINGS

[76] Inventor: Albert G. Bodine, 7877 Woodley Ave., Van Nuys, Calif. 91406

[21] Appl. No.: 709,885

[22] Filed: Mar. 8, 1985

[51] Int. Cl.[4] ..... E21B 7/24

[52] U.S. Cl. ..... 175/56; 175/55

[58] Field of Search ..... 175/55, 56; 184/69

[56] References Cited

U.S. PATENT DOCUMENTS

| | | | |
|---|---|---|---|
| 2,743,083 | 4/1956 | Zublin | 175/56 |
| 3,633,688 | 1/1972 | Bodine | 175/55 |
| 4,023,628 | 5/1977 | Bodine | 175/56 |
| 4,256,190 | 3/1981 | Bodine | 175/56 |

*Primary Examiner*—Stephen J. Novosad
*Assistant Examiner*—Terry Melius
*Attorney, Agent, or Firm*—Edward A. Sokolski

[57] ABSTRACT

Journal bearings are employed to rotatably support the roller cones of a drill bit for drilling wells or the like. Enough clearance is provided at the journal bearing between the bearing pin and the roller cone to accommodate a thick film of fluid lubricant. The bearing is sonically driven, preferably by means of a resonant vibration system, in a torsional vibration mode, the torsional energy being developed in an elastic column which receives such energy from an orbiting mass oscillator. The roller cone is also mechanically rotated by virtue of conventional rotary motion of the drilling string. The energy provided at the bearing from the resonant vibration system, in view of its periodically reversing high G acceleration short-time duration force pulses, effectively operates to increase the gap in the forward portions of the journal bearing between the bearing pin and the roller cone during the "rearward" acceleration of the sonic vibration cycle causing the lubricant to run from the rear portions of the bearing around to the forward portions thereof where the lubricant builds up a thick film so that when the "forward" portion of the cycle reoccurs, there will be an ample oil film in these forward loaded portions to provide the needed lubrication.

8 Claims, 15 Drawing Figures

DRILLING SYSTEM AND METHOD EMPLOYING TORSIONAL SONIC VIBRATION FOR LUBRICATION OF JOURNAL TYPE BIT BEARINGS

This invention relates to drilling systems employing drilling bits rotatably supported on a lubricated journal bearing, and more particularly to such a system employing torsional sonic energy for maintaining the lubricant in the journal bearing when the bit is under heavy rotary turning sidewise loads.

Roller cones bits, such as are commercially available from the Hughes, Reed, and Smith Tool Companies, have come into widespread use for oilwell drilling. This type of bit often employs journal bearings for supporting the cutter heads and has the significant advantage of journal bearings in their ability to handle high loads and speeds. The success of journal bearings hinges upon the maintenance of an adequate thick oil film in the spaces between the bearing interfaces to provide a cushion between the metal parts and thus avoiding metal-to-metal contact with the resultant high wear and eventual destruction of the bearing. This oil film is partially maintained with the rotation of the bearing which vigorously drags the oil film around the bearing annulus. However, the high loads placed on the bearing in drilling operations tends to force the oil out of the space between the bearing interfaces which, of course, obviates the desired lubrication. This problem is particularly acute where the bearings are subjected to a steady load.

It has been found that if the load can be relieved periodically, the oil will tend to migrate back into the loaded region in response to the forces generated by the rotation of the bearing, thus alleviating this problem.

In my U.S. Pat. No. 4,256,190, issued Mar. 17, 1981, a device is described which employs sonic energy in a longitudinal vibration mode which operates to periodically relieve the effects of longitudinal or downward loads on the bearing to effectively compensate the loss of bearing lubrication due to such loads. It has been found, however, that considerable bearing oil film can be lost due to sidewise (lateral) bearing loads in situations where the cutting action involves high rotary torque against the bottom of the bore hole which tends to thin out the oil film, particularly on the front side of the roller cone bearings.

The present invention is directed to solving this particular problem due to sidewise bearing loads from rotary drive. This improved result is achieved in the present invention by providing means for generating *torsional* sonic energy in the drill string directly above the roller cone bits and transmitting this torsional sonic energy, which may be developed with a standing wave vibration of a portion of the drill string, to the roller cone bearings. The torsional vibrational energy developed at the bearings causes the lubricant to run from the rear portions of the bearings to the forward portions thereof, causing the lubricant to build up at this point so that when the forward going portion of the vibration cycle occurs, there will be an ample oil film in these front portions to provide the needed lubrication.

This improved end result is implemented in the present invention by employing a torsional mechanical oscillator which is mounted in the drill string. This oscillator employs eccentric rotors which are rotatably driven, in the preferred embodiment, by a turbine which receives its drive force from the mud flow down the drill string. The device of the present invention may also employ sonic rectification of the torsional energy generated by the mud turbine, this sonic rectification significantly aiding the drilling action of the roller cone bits, thus providing an additional utilization of the energy generated by the mud turbine driven oscillator.

It is therefore an object of this invention to improve the operation of journal bearings for a drilling bit.

It is a further object of this invention to lessen the wear and increase the life of a drilling bit journal bearing.

It is another object of this invention to utilize the mud stream employed for removing the drilling cuttings from the region of the drill bit for driving a mechanical oscillator to generate sonic energy for use both in maintaining oil in the drill bit journal bearings and providing sonic energy for aiding the drilling action.

Other objects of this invention will become apparent as the description proceeds in connection with the accompanying drawings of which:

Figure 1A:
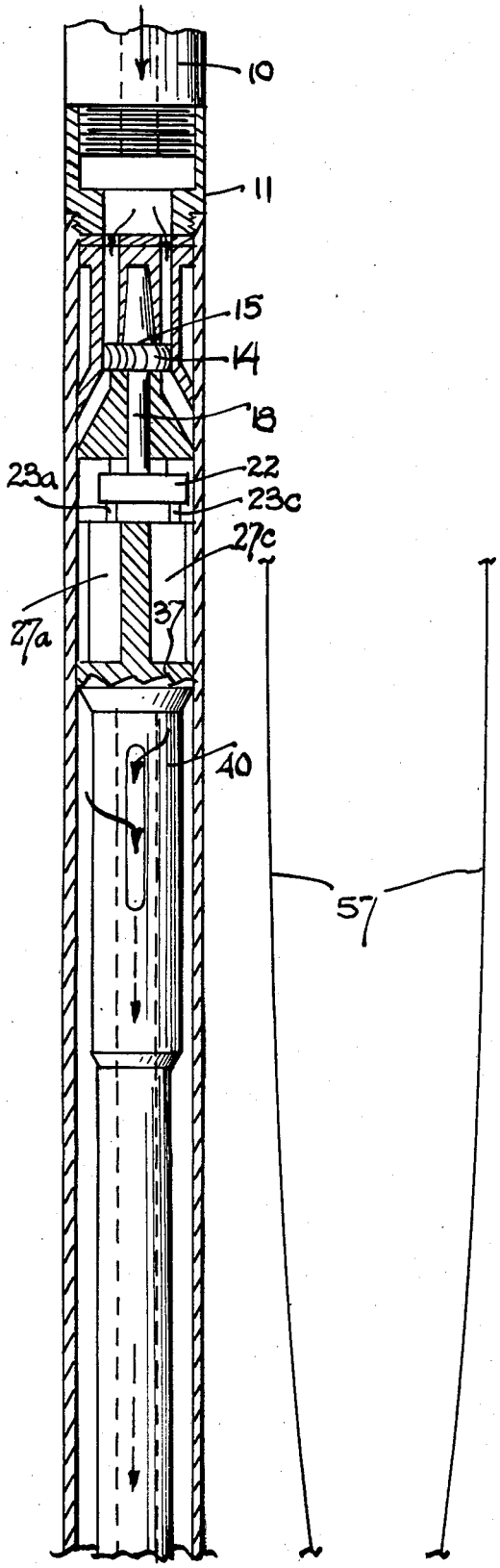
FIGS. 1A and 1B are elevational views in cross section illustrating a preferred embodiment of the device of the invention.
Figure 1B:
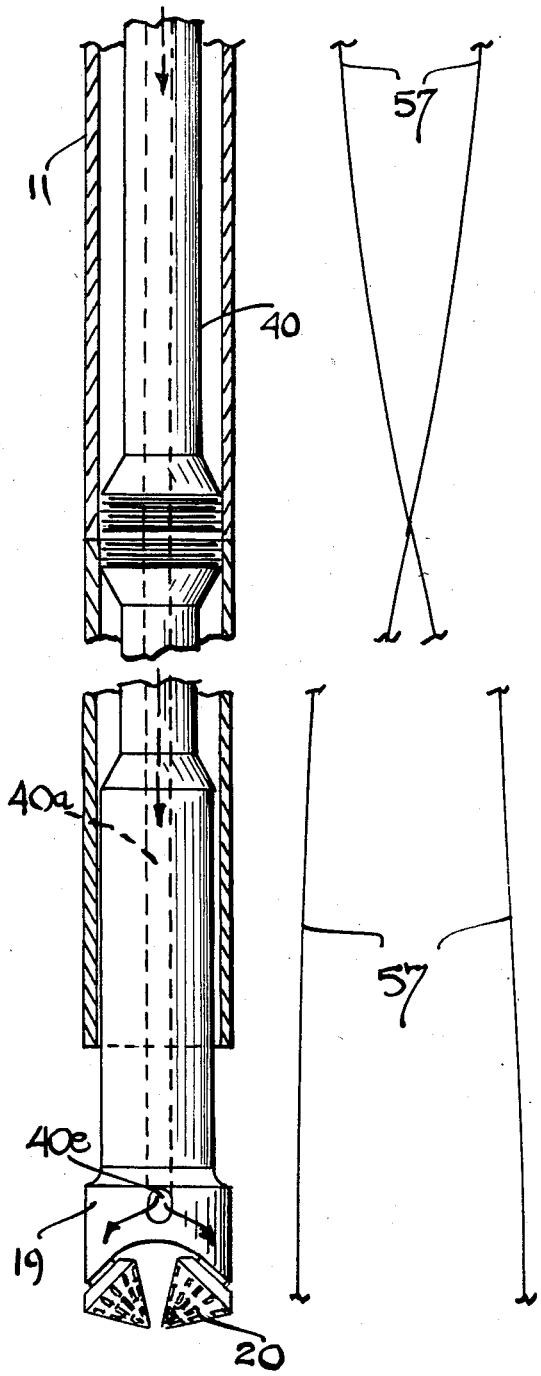
Figure 2A:
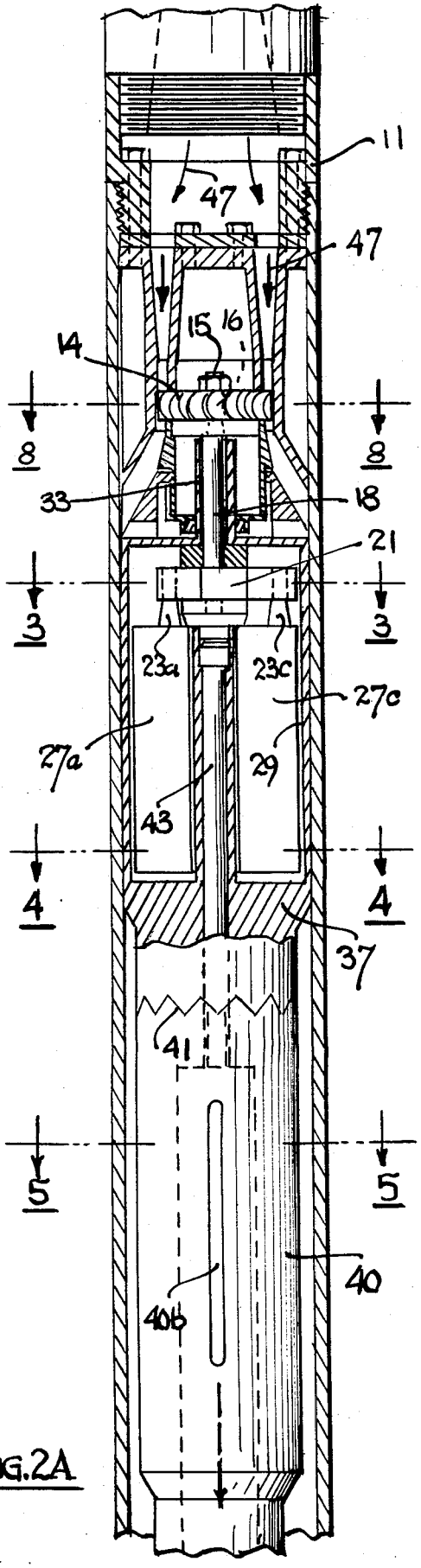
FIG. 2A is a cross-sectional view in elevation of the preferred embodiment illustrating the turbine drive and oscillator of the device of the invention.

Referring now to FIGS. 1A–5 and 8 a preferred embodiment of the invention is illustrated. Collar 11 is attached to the end of the drill collar 10 which is rotatably driven to drive drill bit 19 which is of the roller cone type and is driven in conventional fashion to actuate roller cones 20. Turbine 14 is fixedly attached to shaft 16 by means of nut 15. Shaft 16 has an extension shaft 18 fixedly attached thereto, this extension shaft being fixedly attached to eccentric member 21 of crank link 22. Crank link 22 is coupled by means of crank pins **23*a*–23*d* to eccentric mass oscillator rotor members 27*a*–27*d*, respectively. The rotors are rotatably mounted in journal bearings 29 formed of a suitable low friction material, such as a suitable phenolic, e.g. Mycarta. The bearings 29, in turn, are slidably supported in oscillator housing 37**.

The journal bearings formed between the rotors and the bearing member 29 are lubricated by liquid extracted from the mud fluid which drives turbine 14. The solid particles are separated out from the water which is used as the bearing lubricant by a centrifugal trap 33, the operation of which is fully described in U.S. Pat. No. 4,091,988, issued May 30, 1978, of which I am a co-inventor.

Figure 4:
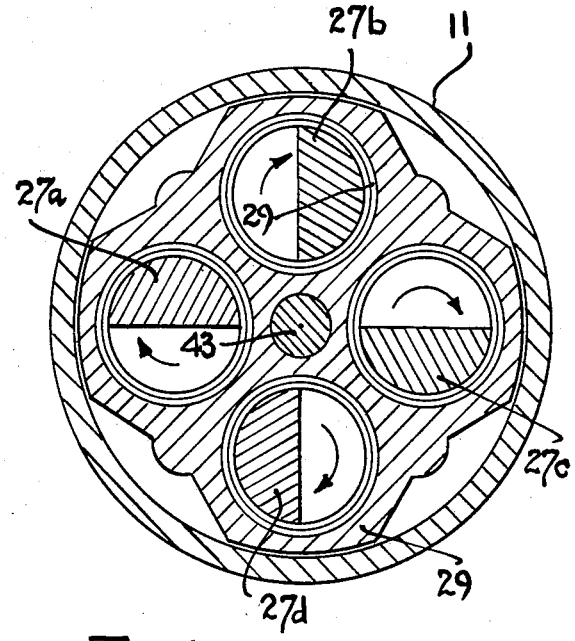
FIG. 4 is a cross-sectional view, taken along the plane indicated by 4—4 in FIG. 2A.
Figure 5:
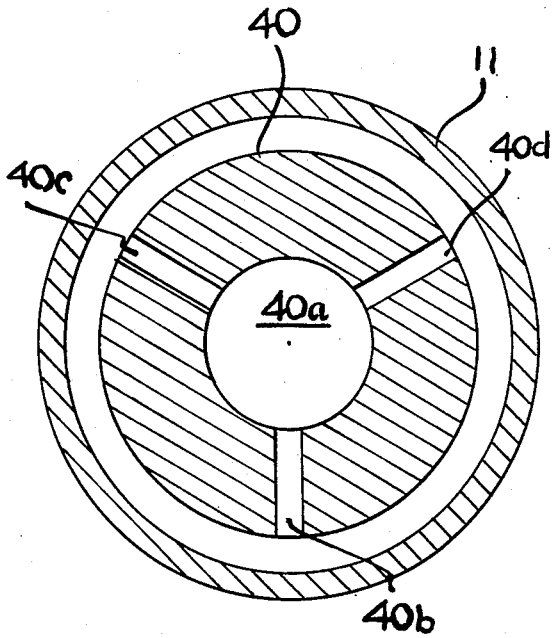
FIG. 5 is a cross-sectional view, taken along the plane indicated by 5—5 in FIG. 2A.
Figure 8:
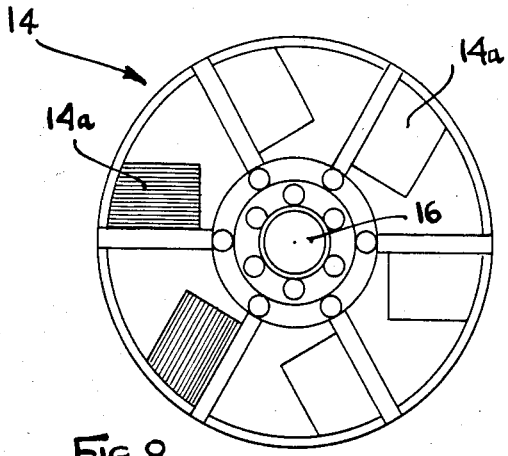
FIG. 8 is a cross sectional view taken along the plane indicated by 8—8 in FIG. 2A.

Rotors 27*a*–27*d* are in the form of half cylinders and are phased as shown in FIG. 4. This makes for a "push-pull" vibrational torque force when the rotors are rotated all in the same direction. Thus, the vibrational effect of the rotors is to neutralize each other radially and to develop a torsional vibrational force by virtue of the in-phase additive forces generated circumferentially, with these forces being successively towards the center of the system and then away from the center of the system (as in the portion of the cycle shown in FIG. 4). The oscillator housing 37 is coupled to elastic bar resonator member 40 by means of a curvic tooth flange 41 and a center bolt 43 which is threadably attached to bar 40. Turbine 14 is of the type described in my U.S. Pat. No. 3,633,688, issued Jan. 11, 1972, the blades 14*a* of the turbine being driven by the downward mud flow indicated by arrows 47. The rotation of the turbine effects rotation of rotors 27*a*–27*d* through the four-pointed crank link 22 and crank pins 23*a*–23*d*, the crank pins rotatably engaging the crank link. The rotors are driven at a speed such as to set up a torsional resonant vibration of bar member 40 at a frequency which is typically of the order of 120–200 hz. A through passage for the mud liquid is provided, as indicated by the arrows in FIG. 2B, through the oscillator casing notches 37*a* and then in the space between bar member 40 and jacket 11 as well as central passageway 40*a* formed in the bar member (See FIG. 5), access to which is provided by means of slots 40*b*–40*d* formed in the bar member (See FIG. 2A). The mud finally exits through aperture 40*e* at the drill bits 20 to perform its usual function in washing away debris.

Figure 2B:
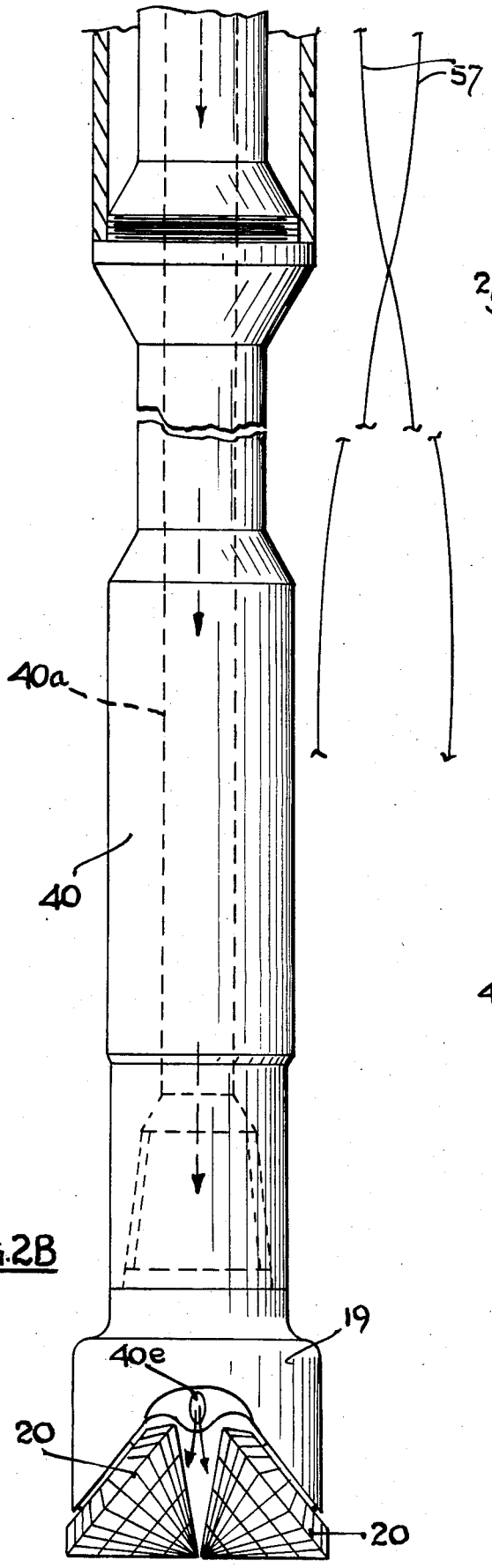
FIG. 2B is an elevational view illustrating the drill bit and sonic rectifier of the device of the invention.

Referring to FIGS. 1A and 2B, a half-wave standing wave pattern 57 of the torsional resonant vibration developed in the system is illustrated. As can be seen, the amplitude of the torsional twisting vibration is maximized in the region of the oscillator and the region of the bits with a "quiet" nodal region appearing about halfway therebetween. The drill jacket 11 is attached by a threaded attachment to the bar member 40 at this nodal point for structural support, there being a minimum transmission of vibrational energy to the drill string at this location.

Figure 6:
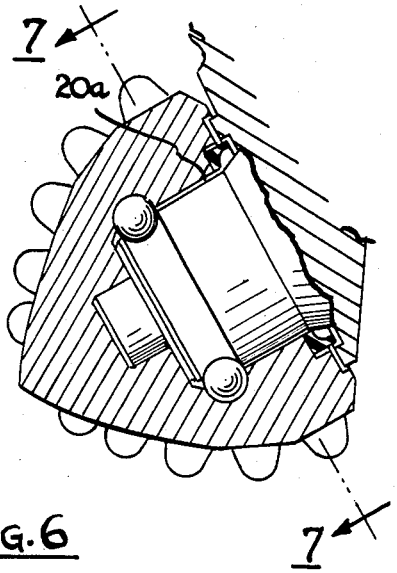
FIG. 6 is a cross-sectional view illustrating a roller cone bit which may be employed in the device of the invention.
Figure 7:
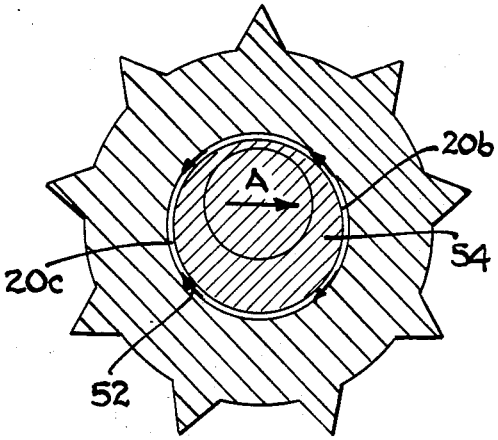
FIG. 7 is a cross-sectional view, taken along the plane indicated by 7—7 in FIG. 6.

Referring now to FIGS. 6 and 7, the torsional vibrational energy is coupled to the journal bearings 20*a* of the bit, this torsional vibration being indicated by arrows 52 in FIG. 7. Operation is as follows. When the resonant bar has passed the midpoint of the forward portion of its torsional vibration cycle, rearward acceleration, as indicated by arrow "A", is applied to the bearing pin 54. This causes the pin to decelerate relative to the roller cone which tends to continue its cyclic velocity forwardly, thereby lessening the gap at the rear portion 20*b* of the bearing and increasing the gap at the front portion 20*c* thereof. This has the effect of forcing oil from the rear portion 20*b* to the front portion 20*c*. In this manner, the lubricant is built up in the front portion of the bearings so that it is available during the peak forward portion of the torsional cycle when it is most needed in this location as normally directed torque loads re-occur. A similar build up of oil on the rear portions of the bearing occurs during the reverse vibratory portions of the cycle. This latter build up is not nearly as important as on the forward cycle in view of the fact that the net forward load is always substantially greater due to the combined operation of normal rotation plus torsional vibration of the drill string. In this manner, a thick oil film is always available on the working side of the bearing when needed, such that when the short duration additional loading providing by the torsional vibration cycle adds to the strong continual rotary drive of drilling, the oil film will not extrude out of the bearing. Further, a good cushioning film of oil is automatically supplied to the front portions of the bearing when it is most needed on the peak of the drilling cycle of a vibratory stroke, thus assuring proper cushioning for the bearing.

Figure 3A:
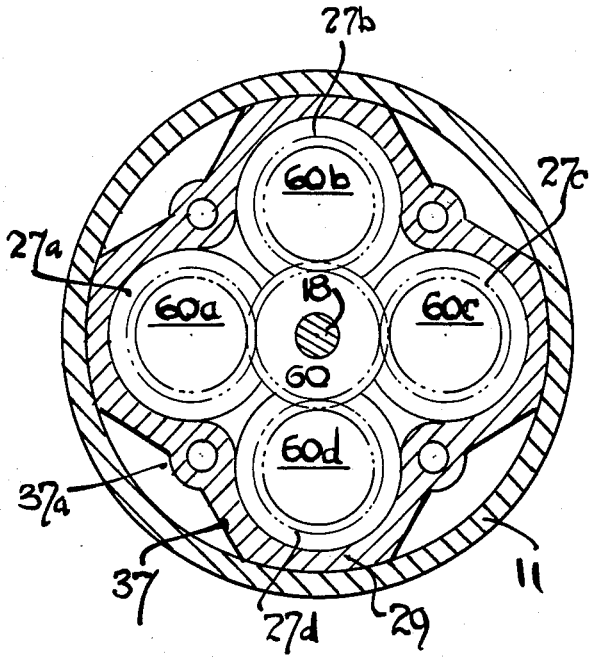
FIG. 3A is an alternative configuration for the mechanism shown in FIG. 3.
Figure 3:
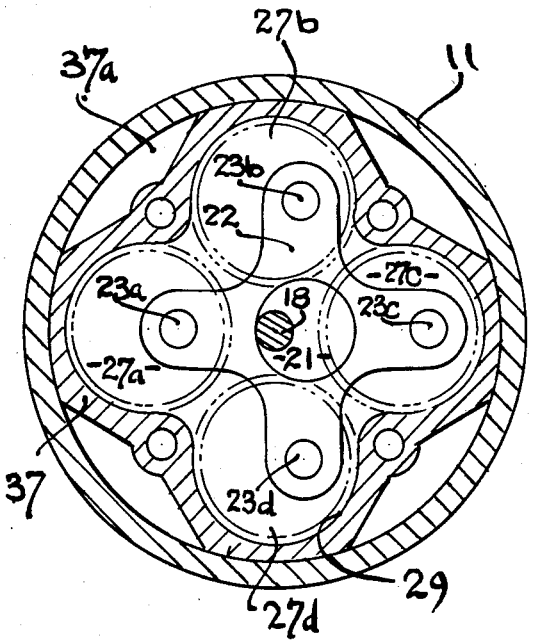
FIG. 3 is a cross-sectional view, taken along the plane indicated by 3—3 in FIG. 2A.

Referring now to FIGS. 3A, an alternative device for rotatably driving the rotors is illustrated. In this alternative drive, a central pinion gear 60 is provided which is rotatably driven by the turbine drive shaft 18. The central pinion gear 60 rotatably drives rotor gears 60*a*–60*d*, each of which is attached to one of rotors 27*a*–27*d*, respectively, to rotatably drive the rotors. Otherwise, the operation is precisely the same as previously described.

Figure 9A:
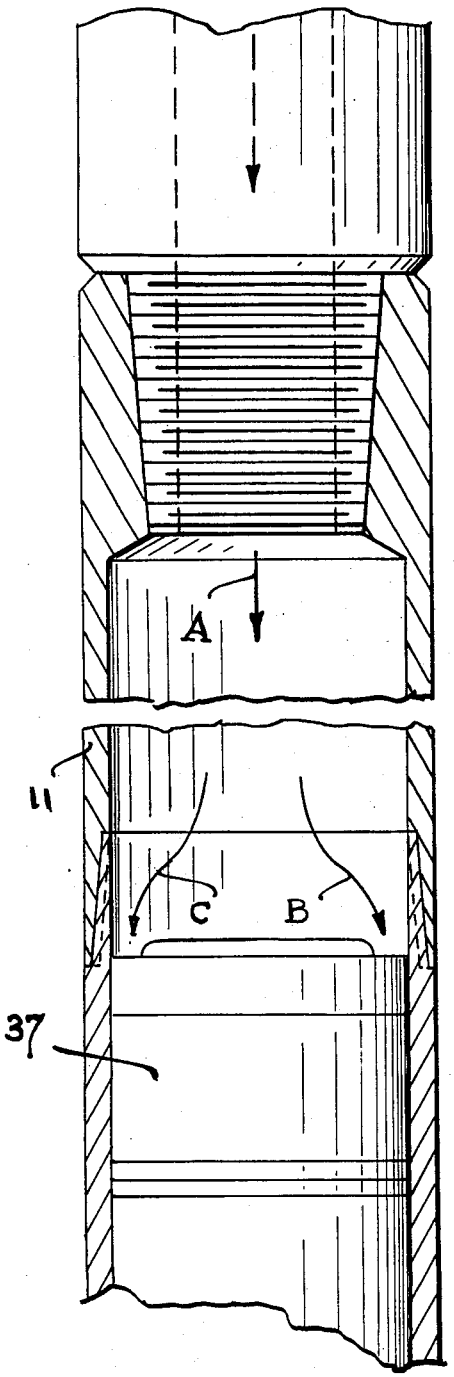
FIGS. 9A and 9B are elevational view in cross-section illustrating a further embodiment of the invention.
Figure 9B:
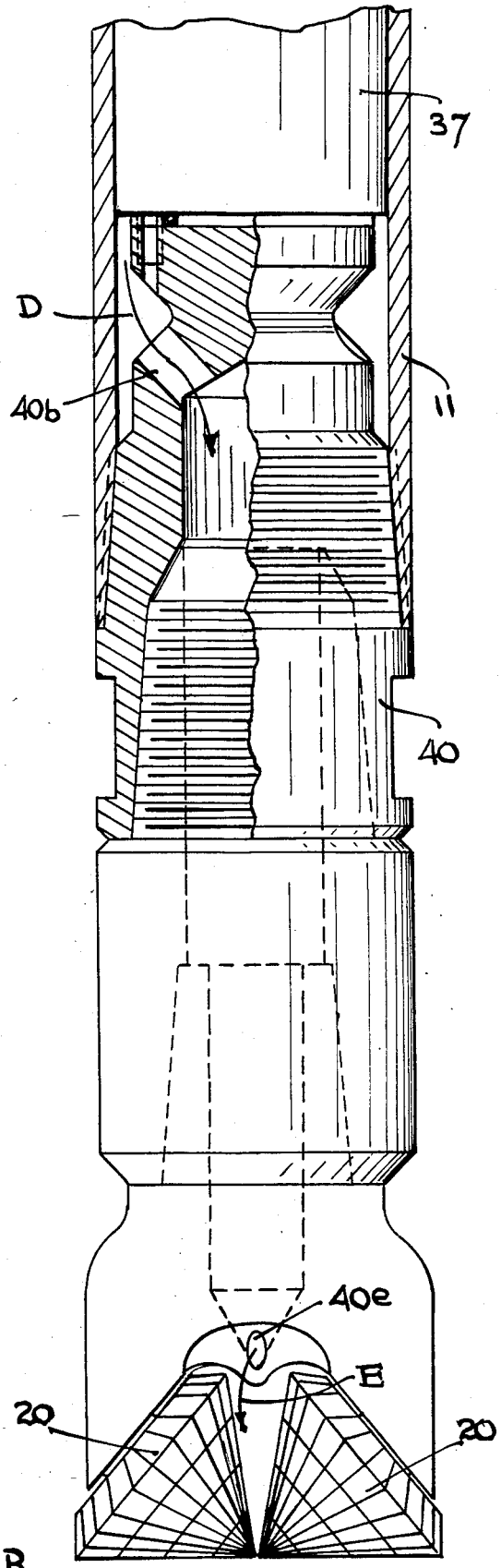
Figure 10:
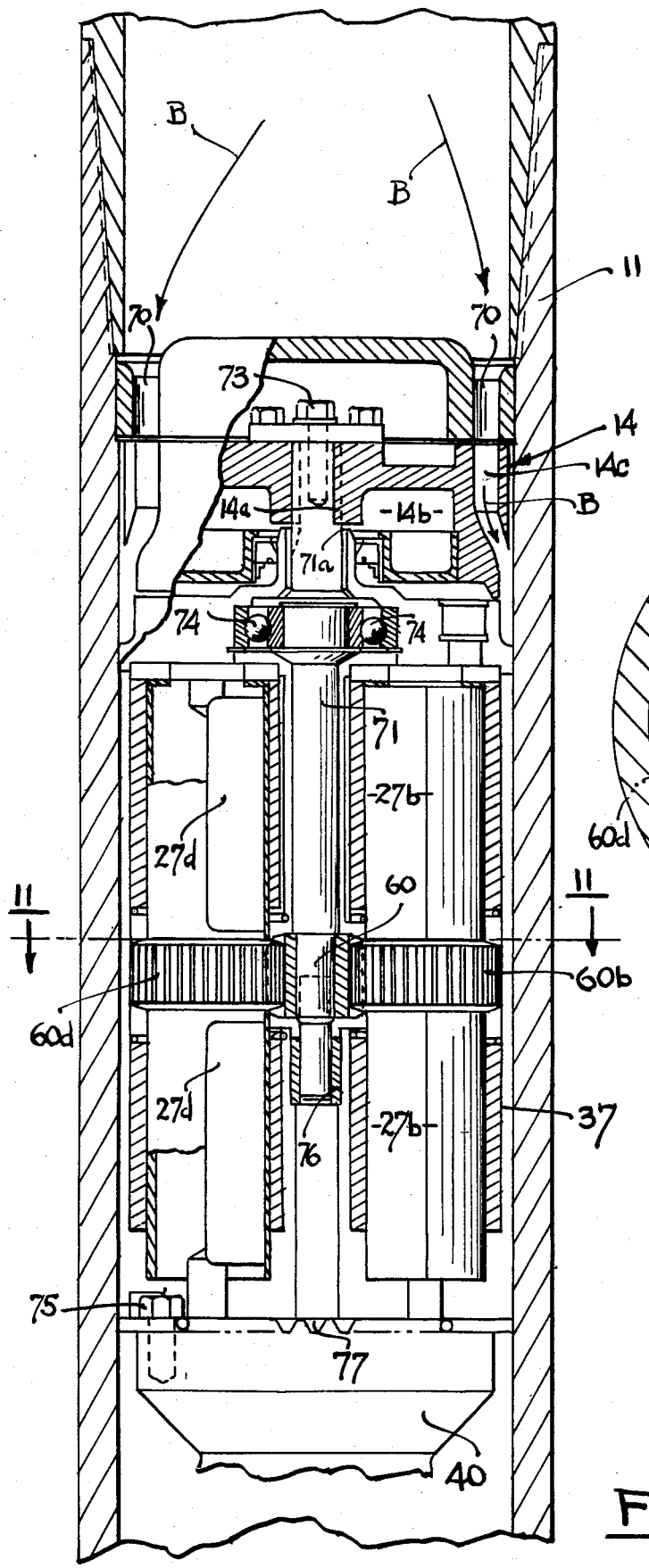
FIG. 10 is an elevational view in corss-section illustrating the oscillator of the embodiment of FIGS. 9A and 9B.
Figure 11:
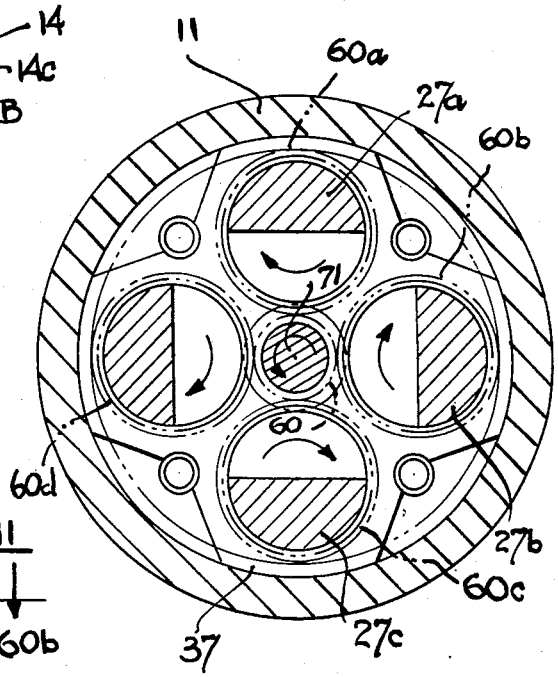
FIG. 11 is a cross-sectional view taken along the plane indicated by 11—11 in FIG. 10.

Referring now to FIGS. 9–11, a further embodiment of the invention is illustrated. This embodiment is particularly adapted to accommodate a wire line instrument used to measure the angular slope and direction of the bore hole; this end result being achieved by placing an oscillator down hole close to the bit. This arrangement also has the advantage of enabling the construction of the oscillator and drill bit asemblies as a combined unit that can be assembled and tested together. As shown in FIGS. 9A and 9B, the oscillator housing 37 is mounted within casing 11 near the bottom end thereof. The oscillator housing is directly connected to bar member 40 which transmits sonic energy therefrom to the journal bearings of the bit as in the previous embodiments. Jacket 11 is directly connected to bar member 40 to form a part of the resonant vibration system. These combined elements are typically about 22 feet in length which affords a quarter wave vibration system at a frequency of the order of 120 Hertz. Mud flow through the jacket and oscillator are indicated by arrows "A–D", there being appropriate slots and openings such as slots 40*b* to permit such flow. The mud is exited out into the bore hole as indicated by arrow "E" through apertures 40*e* formed in the bit assembly 20.

Referring now to FIGS. 10 and 11, the structure of the oscillator and turbine drive therefor are illustrated. The mud flow as indicated by arrows "B" is channeled through nozzles 70 against the blades 14*c* of turbine 14, rotatably driving the turbine. The turbine is retained with its drive splines 14*a* in driving engagement with the splines 71*a* of drive shaft 71 by means of bolt 73. Drive shaft 71 is mounted for rotation on ball bearings 74 and pilot bearing 76. A sand trap 14*b* is provided in the turbine to entrap sand which may be centrifugally thrown clear of the bearings. Pinion gear 60 is fixedly attached to drive shaft 71 and rotatably drives gears 60*a*–60*d* which are attached respectively to rotors 27*a*–27*d*. The gears 60*a*–60*d* are thus mounted in the center of rotors 27*a*–27*b* repectively. Otherwise, the basic structure and operation of the rotors is the same as that for the first embodiment as best shown in FIG. 3A. The oscillator housing 37 is retained to bar member 40 by means of coupling bolts 75. Rotational motion between the oscillator housing and the bar member 40 is obviated by means of curvic coupling 77.

The operation of the this embodiment is similar to the previously described embodiments except for the fact that the oscillator is located close to the bit which as already noted is particularly suited for facilitating the use of a wire line instrument to measure angular slope and direction. Improved drilling action can be obtained by fabricating one of the rotors 27*a*–27*d* of a material such as tungsten having a substantially heavier mass than that of the other rotors. This induces a superimposed quadature vibration of the oscillator providing a cycloidal action which is superimposed upon the torsional oscillation of the bit.

While the invention has been described and illustrated in detail, it is to be clearly understood that this is intended by way of illustration and example only and is not to be taken by way of limitation, the spirit and scope of the invention being limited only by the terms of the following claims.

I claim:

1. In a drilling system employing a roller cone bit supported for rotation on a journal bearing formed between a bearing pin and said roller cone, there being a film of fluid lubricant between the pin and the roller cone to provide a bearing medium therebetween, the improvement whereby ample amounts of said lubricant are maintained throughout the gap between the pin and the roller cone under high lateral bearing loads comprising sonic oscillator means mounted above the bearing for generating sonic energy in a torsional push-pull vibration mode, and means coupled to said oscillator means for transmitting said torsional push-pull sonic energy to said bearing, the torsional sonic energy causing the lubricant to cyclically build up on opposite laterally loaded sides of the bearing, thereby driving extra lubricant to the bearing portions where most needed during the vibration cycle to provide cushioning films in a periodic fashion.

2. The drilling system of claim 1 wherein said means for generating the sonic energy comprises eccentric rotors, means for rotatably supporting said rotors, and means for rotatably driving said rotors on said supporting means.

3. The drilling system of claim 2, wherein said means for transmitting said torsional sonic energy to said bearing comprises a bar member, said bar member being driven by said sonic energy in a resonant standing wave torsional vibration mode.

4. The drilling system of claim 1 wherein the means for rotatably driving the rotors comprises a bladed turbine and means for conducting a flow of mud liquid against said turbine to cause the rotation thereof.

5. The drilling system of claim 3 and further including sonic rectifier means interposed between the bar member and the bearing for rectifying the sonic energy to provide torsional indirectional impulses to the bearing.

6. A method for maintaining lubricant in the journal bearing of a roller cone drilling bit which is rotatably driven by a drill string, generating push-pull torsional sonic energy by means of a mechanical oscillator, coupling said sonic energy to said drill string, driving said oscillator at a speed such as to effect torsional standing wave resonant vibration of the drill string, and coupling sonic energy from the drill string to the bearing, the torsional sonic energy periodically driving lubricant to the front and rear portions of the bearing.

7. The method of claim 6 and additionally including the step of rectifying the sonic energy coupled from the drill string to the bearing.

8. The method of claim 7 wherein the oscillator is driven by a mud turbine.

* * * * *